US005704649A

United States Patent [19]

Small

[11] Patent Number: 5,704,649

[45] Date of Patent: Jan. 6, 1998

[54] PACKAGE CLOSING LABEL

[75] Inventor: Tobby Lynn Small, St. Petersburg, Fla.

[73] Assignee: Moore Business Forms, Inc., Grand Island, N.Y.

[21] Appl. No.: 566,918

[22] Filed: Dec. 4, 1995

[51] Int. Cl.[6] ..... B42D 15/00

[52] U.S. Cl. ..... 283/81; 283/101; 283/106; 428/40.1; 428/41.8; 428/202; 40/630; 40/638

[58] Field of Search ..... 283/79–81, 100, 283/101, 106; 428/40.1, 41.8, 202; 40/306, 310, 630, 638, 665, 637

[56] References Cited

U.S. PATENT DOCUMENTS

| | | | |
|---|---|---|---|
| 401,210 | 4/1889 | Reed . | |
| 1,532,900 | 4/1925 | Houghland . | |
| 1,896,834 | 2/1933 | Brown . | |
| 2,141,011 | 12/1938 | Monk . | |
| 3,211,470 | 10/1965 | Wilson . | |
| 3,495,758 | 2/1970 | Wienecke, Jr. . | |
| 3,999,819 | 12/1976 | Schreyer | 402/4 X |
| 4,110,502 | 8/1978 | Baer | 283/81 X |
| 4,202,464 | 5/1980 | Mohs et al. . | |
| 4,557,971 | 12/1985 | Williams . | |
| 4,679,823 | 7/1987 | Nagy . | |
| 4,708,368 | 11/1987 | Instance . | |
| 4,716,052 | 12/1987 | Waugh et al. | 427/147 |
| 4,771,891 | 9/1988 | Sorensen et al. | 40/638 X |
| 4,889,234 | 12/1989 | Sorensen et al. | 40/638 X |
| 5,031,939 | 7/1991 | Webendorfer et al. | 283/81 |
| 5,217,307 | 6/1993 | McClintock | 428/43 X |
| 5,348,780 | 9/1994 | Boggs et al. | 283/81 X |
| 5,417,457 | 5/1995 | Reinhardt . | |

FOREIGN PATENT DOCUMENTS

| | | |
|---|---|---|
| 0386849 | 9/1990 | European Pat. Off. . |
| 0605969 | 7/1994 | European Pat. Off. . |

*Primary Examiner*—Frances Han
*Attorney, Agent, or Firm*—Nixon & Vanderhye P.C.

[57] ABSTRACT

A packaging label includes a first portion with permanent pressure sensitive adhesive on its bottom face and a second portion substantially perpendicular to the first portion and having permanent pressure sensitive adhesive on the bottom face remote from the first portion. The second portion typically includes nutritional information and bar coding since the label is typically used with clam shell plastic packages for fruits or other food items. The first portion of the label is adhesively secured to the lid of a clam shell container and after the container is filled with food items, the lid is closed, the second portion of the label is unfolded from a compact position which facilitates stacking and transportation, and the adhesive on the second portion is secured to the bottom of the container, holding the lid closed. The bar coding is preferably on the top face of the second portion opposite the adhesive so that it can be scanned merely by dragging the bottom of the container over a scanner (e.g. in a grocery store).

20 Claims, 4 Drawing Sheets

PACKAGE CLOSING LABEL

BACKGROUND AND SUMMARY OF THE INVENTION

Conventional clam shell containers for packaging produce and other food items are made of transparent polyethylene and are utilized by a number of field packers. Typically the field packers label the clam shell containers, so that the labels indicate what produce (e.g. strawberries, brussel sprouts, grapes, or the like) is packed thereby, the produce is packed, and the containers are shipped to a retail outlet. The retailer then typically culls the produce (removes bruised, spoiled, or otherwise unacceptable items or portions) and then seals the container with tape to prevent the consumer from making any "adjustments" to the contents of the container. Typically the labels do not include product look-up (PLU) numbers, bar codes, or nutrition facts. Bar code labels are typically applied separately by the retailer to the bottom of the containers or applied by the packer in a separate operation.

According to the present invention a packaging label assembly is provided which provides a number of advantages compared to the prior art described above, providing in combination with a conventional clam shell container an advantageous package assembly, and providing an advantageous method of packaging food items. The packaging label according to the present invention is large enough to provide PLU numbers, nutritional information, and bar coding; allows the retailer to use the same label assembly applied by the packer, after culling, to permanent close the container; and avoids the necessity of applying separate bar code labels.

According to one aspect of the present invention a packaging label assembly is provided comprising the following components: A first portion comprising a base elongated in a first dimension and having first and second opposite faces. A first pressure sensitive adhesive pattern on the first portion second face covering at least part of the second face. A second portion comprising a base elongated in a second dimension substantially perpendicular to the first dimension and having first and second opposite faces and first and second ends spaced from each other in the second dimension of elongation. The second portion connected to the first portion adjacent the first end thereof so that the first and second faces of the first and second portions may be disposed so that they are substantially coplanar. A first fold line adjacent the first end of the second portion for allowing folding of the second portion with respect to the first portion. Indicia on the second portion first face. A second pressure sensitive adhesive pattern on the second portion second face remote from the first fold line. A non-stick area of the second portion second face between the first fold line and the second adhesive pattern. And, a second fold line between the second adhesive pattern and the non-stick area.

The adhesive patterns preferably are both permanent adhesive, and the non-stick area of the second port-ion preferably comprises silicone release material substantially co-extensive in area with the second adhesive pattern. The adhesive patterns are typically substantially solid, although they may be formed by spaced dots, lines, or other configurations. Typically a lift tab is provided at the second end of the second portion, which is devoid of adhesive on the second face thereof, to facilitate unfolding of the second portion, and detachment of the second adhesive portion from the non-stick area.

The indicia on the second portion first face typically includes food nutritional information, and also typically includes PLU numbers and further includes bar coding opposite the second adhesive portion.

The label assembly may further comprise a third fold line in the second portion adjacent the non-stick area on the opposite side thereof from the second adhesive pattern, and a fourth fold line in the second portion between the first and third fold lines. The length of the first portion between the first end and the second end thereof is typically between about 4–8 inches, e.g. about 6½ inches. The second portion second face between the first and third fold lines is typically devoid of adhesive.

A wide variety of additional components or features, or modifications, may be provided. For example indicia indicating the contents of the package (e.g. "strawberries") may be provided on the first portion first face, and the first and second portions preferably comprise an integral piece of cellulose stock. The term "cellulose stock" as used in the present specification and claims means paper, or imagible paper containing laminates, or combinations of paper and plastic fibers which include a significant amount of paper fibers and are imagible.

According to another aspect of the present invention a package assembly (typically utilizing the label assembly as described above) is provided. The package assembly comprises the following features and components: A container body including an open top base for containing product therein, and a lid pivotally connected to the base and movable between an open position in which the base top is uncovered, and a closed position in which the base open top is closed by the lid. A label assembly comprising a first portion adhesively secured to the lid, and a second portion having a first end connected to the first portion, and a second end remote from the first portion, the second portion having a pressure sensitive adhesive section adjacent the second end thereof and a non-adhesive section between the adhesive section and the first end. Indicia indicating the contents of the container body imaged on at least one of the label assembly first and second portions. And, the adhesive section of the second portion spaced from the first portion a distance greater than the circumferential distance between the first portion and the base when the lid is in the closed position.

The second portion may include a plurality of fold lines formed therein so that the second portion is movable from a first position in which it substantially overlaps, or is substantially overlapped by, the first portion, to a second position in which the second end thereof is remote from the first portion and adhesively secured to the base of the container body by the adhesive section. The indicia typically comprises nutritional information about a food product packaged by the container body, and a bar code, the nutritional information and the bar code typically being provided on the second portion. The label assembly is typically of cellulose stock.

The container base typically includes a bottom portion opposite the open top and lid. The indicia includes a bar code corresponding to a food product packaged by the container body disposed on the second portion adjacent the second end thereof, and the adhesive section on the second body is adhesively secured to the bottom portion of the container base, and the bar code overlaps the bottom portion and is scannable by moving the bottom portion of the container body over a scanner. Preferably the first and second portions are adhesively secured to the lid and bottom portion, respectively, by permanent adhesive. The permanent adhesive of the second portion is typically spaced from the first portion about 3–7 inches for a common size of polyethylene dam shell packages.

The package assembly is typically provided in a stack—at one point during its utilization—with a plurality of other substantially identical package assemblies so that the container bodies of each are in a first stack and so that the lids with attached label assemblies of each are in a second stack connected to the first stack.

The invention also relates to a method of packaging food items in clam shell plastic containers as described above. The method comprises the steps of substantially sequentially: (a) Adhesively securing a label assembly first portion to a lid of each claim shell container, with the label assembly folded up so that it does not extend past the lid. (b) Stacking the clam shell containers into a stack in which the bodies and lids are disposed in two separate stacks with pivotal connections therebetween. (c) Transporting the stacked clam shell containers to a packaging location. (d) At the packaging location removing containers from the stack and filling them with a food product. (e) At the packaging location pivoting the lid of each filled container to a position closing the open top thereof with the lid. And, (f) unfolding the label assembly of each filled container and adhesively securing the second portion pressure sensitive adhesive section thereof to the container body.

The label assembly second portion typically has a bar code on an opposite face thereof from the adhesive section, and the container body includes a bottom. In that case step (f) is practiced so as to adhesively secure the adhesive section to the bottom of the container body so that the bar code is readily scannable by moving the bottom of the container over a scanner. Where the food items are not particularly perishable or braisable step (f) may also be practiced at the packaging location. However where the food product is perishable or bruisable, such as conventional berries, gapes, and other produce, there are the further steps, between steps (e) and (f), of (g) transporting the containers to a retail establishment, and (h) culling the produce at the retail establishment.

It is the primary object of the present invention to provide for the simple yet effective packaging of items in containers, particularly produce in clam shell containers. This and other objects of the invention will become clear from an inspection of the detailed description of the invention and from the appended claims.

DETAILED DESCRIPTION OF THE DRAWINGS

Figure 1:
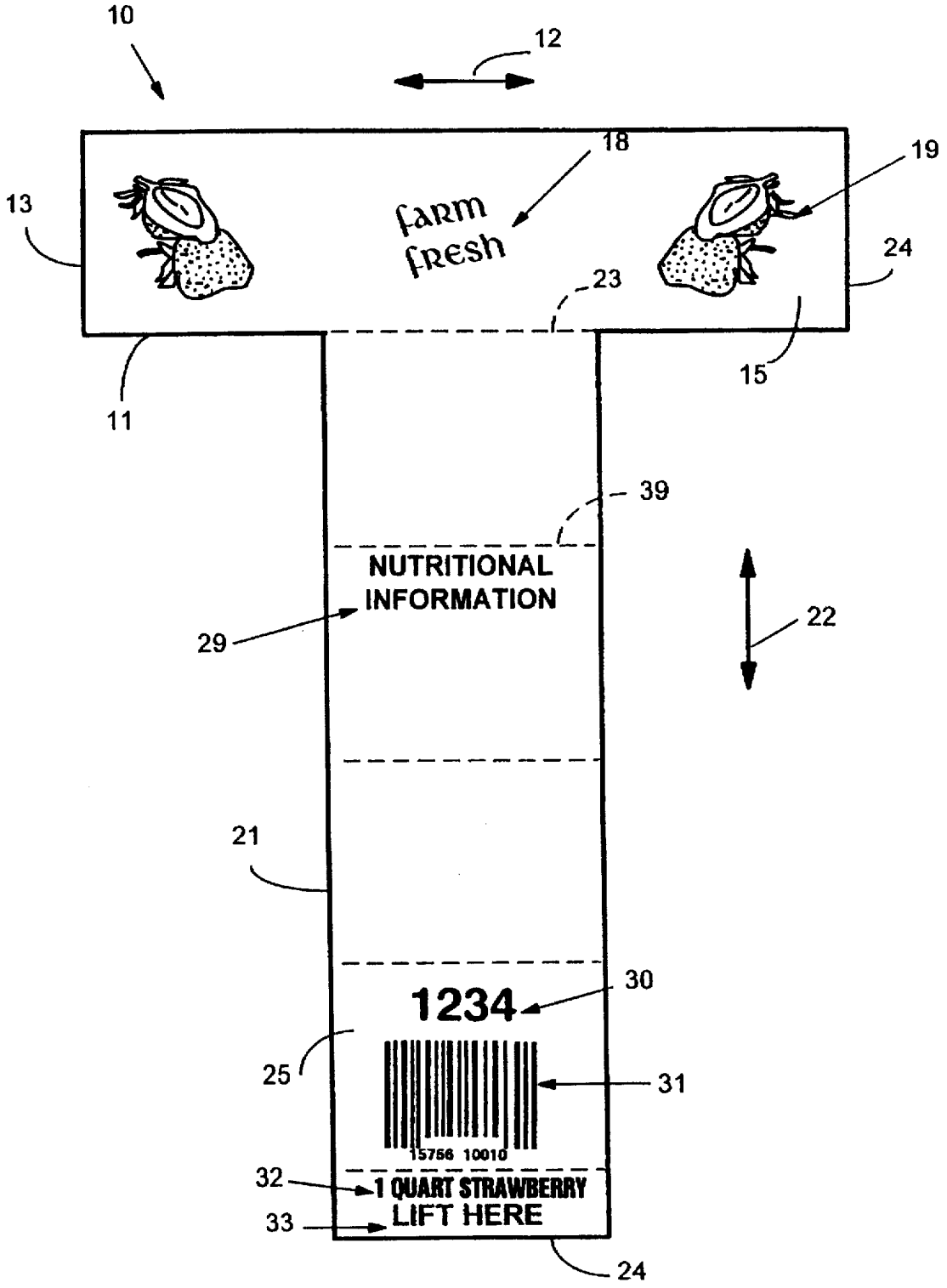
FIG. 1 is a full scale top plan view of an exemplary label assembly according to the present invention in a deployed configuration.
Figure 2:
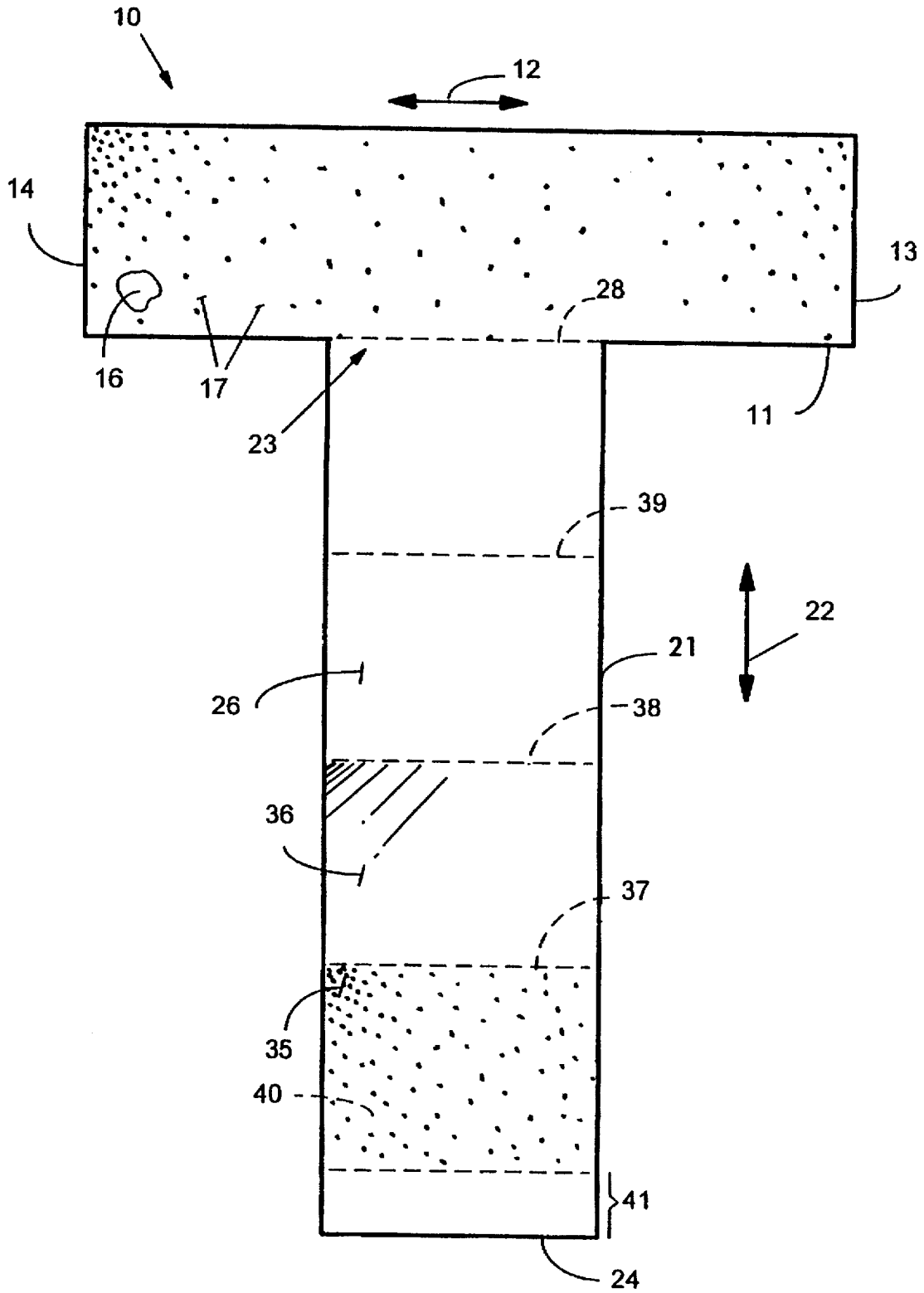
FIG. 2 is a full scale bottom plan view of the label assembly of FIG. 1.
Figure 3:
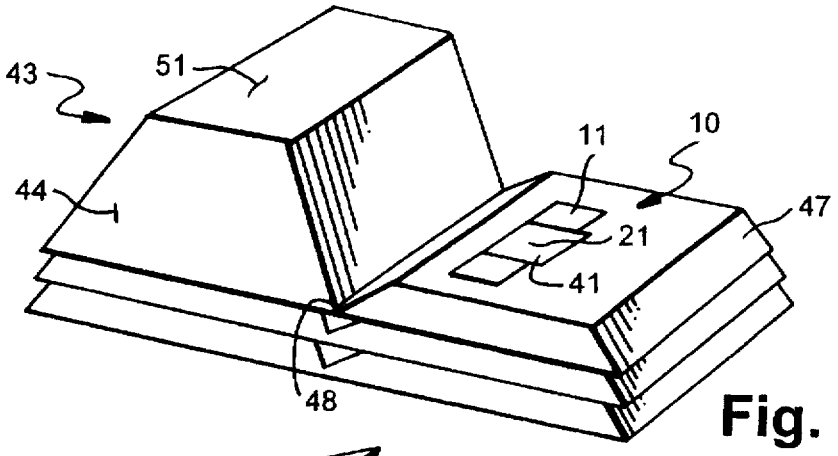
FIG. 3 is a top perspective view showing a stack of package assemblies according to the invention, with the label assembly of FIGS. 1 and 2 in a folded up condition provided thereon.

FIGS. 1 and 2 illustrate an exemplary embodiment of a packaging label assembly according to the present invention. The label assembly, shown generally by reference numeral 10, includes a first portion 11, comprising a base (typically of cellulose stock) elongated in a first dimension 12, and having first and second ends 13, 14, and first and second opposite faces 15 (see FIG. 1) and 16 (see FIG. 2) respectively, the first face 15 typically being the "top" face while the second face 16 is the "bottom" face. A first adhesive pattern 17 (see FIG. 2) is disposed on the second face 16, covering at least part of the second face 16. The adhesive 17 is preferably a pressure sensitive permanent adhesive and typically is applied in a continuous manner as illustrated in FIG. 3, and substantially completely covers the face 16. However other patterns may be utilized, such as spaced blocks of adhesive (see 17' in FIG. 8), spaced dots, spaced s strips, or the like. Typically indicia is imaged on the first face 15 of the first portion 11, such as the word indicia 18 indicating what the contents of the package with which the label assembly 10 is utilized, and/or graphics 19 (e.g. a pictorial representation of the contents of the package).

The packaging label assembly 10 further comprises a second portion 21 comprising a base (typically of cellulose stock) elongated in a second dimension 22 substantially perpendicular to the first dimension 12, and having first and second ends 23, 24 spaced from each other in a dimension of elongation 22, and having first and second opposite faces 25 (see FIG. 1) and 26 (see FIG. 2). The second portion 21 is connected to the first portion 11 at the first end 23 thereof so that the first and second faces 15, 25 and 16, 26, respectively, of the first and second portions 11, 21 may be disposed so that they are substantially co-planar, as illustrated in FIG. 1. Preferably the portions 11, 21 are formed of an integral piece of paper stock which may die cut, or otherwise detached, from a web of cellulose stock to which various coatings and images have been applied.

A first fold line, best seen at 28 in FIG. 2, is provided adjacent the first end 23 of the second portion 21 for allowing folding of the second portion 21 with respect to the first portion 11. Fold line 28 in the embodiment illustrated in FIG. 3 is shown as a perforation line, but it may be formed by a score line, a partially die cut line, a crease line, or in any other manner that facilitates precise folding thereabout.

As seen in FIG. 1, indicia is imaged on the second portion 21 first face 25. The indicia typically includes—where the packaging label assembly 10 is used to package food items—nutritional information indicia 29, a PLU number 30, bar coding 31, contents indicia 32 distinct from the bar coding 31, and/or directional indicia 33. The packaging label assembly 10 is large enough to include all of this indicia comfortably while still providing an area for graphics, logos, or the like.

As see in FIG. 2, the label assembly 10 also includes a second pressure sensitive adhesive pattern 35 disposed on the face 26 remote from the first fold line 28, and preferably adjacent the second end 24, and a non-stick area 36 between the fold line 28 and the second adhesive pattern 35. The pattern 35 preferably also is of permanent pressure sensitive adhesive, and as seen in FIG. 2 comprises a substantially continuous block of adhesive, although other patterns (such as dots, spaced blocks, lines, or the like), may be provided. The non-stick area 36 is substantially co-extensive with the adhesive pattern 35, and where the adhesive pattern 35 is permanent adhesive typically comprises a silicone release coating, or like readily adhesive-releasable material. Typically the silicone adhesive-release material 36, when used, is in block form comparable to the block form of the adhesive pattern 35.

The label assembly 10 also preferably comprises a second fold line 37 (see FIG. 2) between the adhesive pattern 35 and the non-stick area 36 to allow folding of the second portion 21 thereat. The second fold line 37 may be of any conventional type, as described above with respect to the first fold line 28.

In the preferred embodiment illustrated in FIG. 2, third and fourth fold lines 38, 39 (see FIG. 2) are also provided, the third fold line 38 adjacent the non-stick area 36 on the opposite side thereof from the second adhesive pattern 35, and the fourth fold line 39 between the first and third fold lines 28, 38. A fifth fold line, typically in the form of a line of weakness such as a perforation, 40 may also be provided separating the second adhesive portion 35 from a lift tab portion 41 at the second end 24.

In the embodiment illustrated in FIGS. 1 and 2, the length of the second portion 21—between the ends 23, 24 thereof—is between about four-eight inches, depending upon the size of the clam shell container (to be described below) with which it is to be utilized. In the preferred embodiment—as seen by the full scale illustrations in FIGS. 1 and 2—the spacings between each of the lines 28, 39; 39, 38; 38, 37; and 37, 40; is about one and a half inches for a total length of the second portion 21 of about six and a quarter-six and a half inches.

The label assembly 10 of FIGS. 1 and 2 is constructed so that it may be folded up to the folded configuration illustrated in FIG. 3 in which the second portion 21 overlaps the first portion 11 with essentially only the tab 41 extending outwardly therefrom (the width of the first portion 11 being about one and one-half inches in the embodiment illustrated in FIGS. 1 through 3). When in the folded up configuration illustrated in FIG. 3, the adhesive 35 engages the silicone release material 36. While normally the inertia provided by folding about the fold line 28, 38, 39—combined with the "weight" of the parts of the portion 21 containing the adhesive 35 and silicone release material 36—is sufficient to maintain the folded up configuration illustrated in FIG. 3, if necessary to further provide such a configuration, repositional adhesive may be provided on the face 26 between the fold lines 38, 39, and repositional adhesive provided on the face 25 between the fold lines 28, 39. The conventional repositional adhesive may be provided in any desired pattern.

In FIG. 3, the label assembly 10 is shown as part of a package assembly—illustrated generally by reference numeral 43—according to the present invention.

Figure 4:
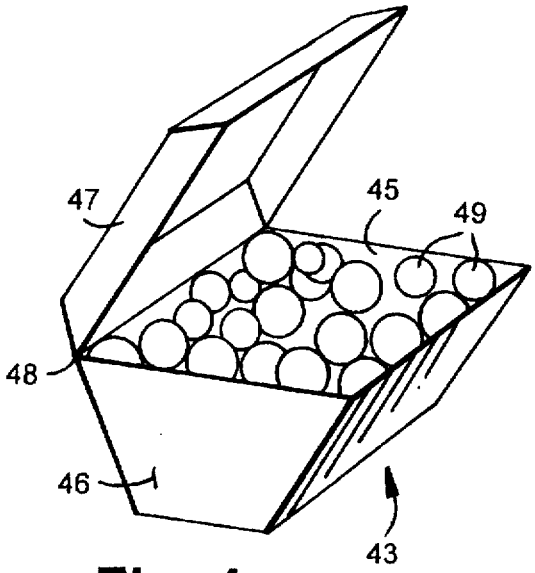
FIG. 4 is a top perspective view of a package of FIG. 3 filled with produce.

In addition to the label assembly 10 the package assembly 43 comprises a container body 44 having an open top 45 (see FIG. 4) for the base 46 thereof and a lid 47 pivotally connected (e.g. by integral hinge 48) to the base 46. The lid 47 is movable about the pivot connection 48 between an open position (as illustrated in FIGS. 3 and 4) in which the open top 45 is uncovered, and a closed position (FIGS. 5 and 6) in which the open top 45 is closed by the lid 47. While different lids, bases, and hinges, may be provided (almost any conventional constructions being suitable), in the most desirable configuration according to the invention the container body 44 comprises a clam shell container of transparent plastic (e.g. polyethylene).

Figure 5:
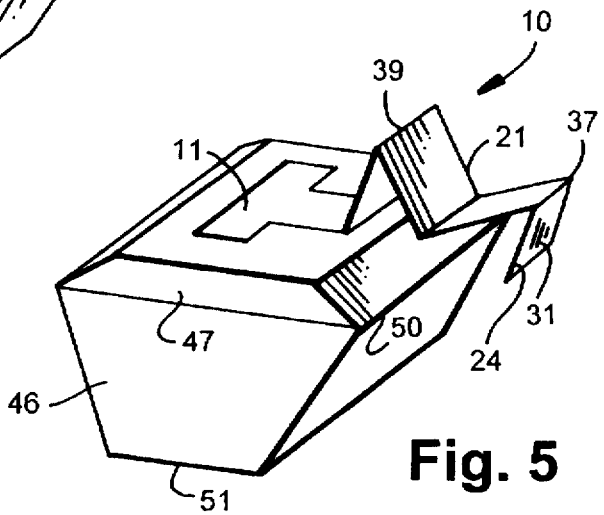
FIG. 5 is a top perspective view of the package of FIG. 4 after the lid has been closed and as the label assembly is being deployed.
Figure 6:
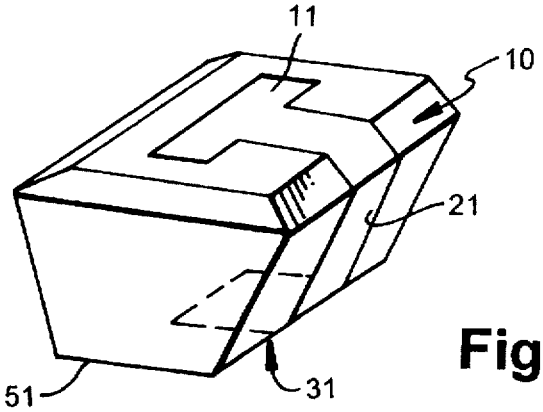
FIG. 6 is a view like that of FIG. 5 with the label assembly completely deployed and holding the container lid closed.

As illustrated in FIGS. 3, 5, and 6 the first portion 11 of the label assembly 10 is secured by the permanent adhesive 17 to the top of the lid 47 with the tab 41 facing away from the hinge 48. As seen in FIG. 3 the package assemblies 43 may be stacked with the label assembly 10 attached to the lid 47 of each package 43 in the stack.

FIGS. 3 through 6 illustrate schematically a preferred method of packaging food items in clam shell plastic containers 43 utilizing the label assemblies 10. As seen in FIG. 3, the label assemblies 10 are applied to the lids 47 (either by machine or by hand) with the label assemblies 10 in the folded configuration illustrated in FIG. 3, allowing the packages 43 to be restacked and cartoned. The stacked containers as illustrated in FIG. 3 are transported to a packaging location, such as an actual field where produce is being grown, or a packing house. At the packing location the package 43 is filled with food product, such as the produce (e.g. berries) 49 illustrated in FIG. 4 and then the lid 47 is closed. As is conventional for clam shell packaging, locking portions (not shown) between the lid 47 and the base 46 hold the lid 47 in place.

Where the food items 49 being packaged are not particularly perishable or subject to damage during shipment, the label assembly 10 may be deployed at that point; however in a typical situation the closed packages 43 are shipped to a retailer. At the retailer the package 47 is opened up by pivoting the lid 47 upwardly about the pivot 48 (to a position illustrated in FIG. 4), and the retailer culls the produce 49. Then the lid 47 is reclosed, as illustrated in FIG. 5, and the label assembly 10 deployed, typically by grasping the tab 41 and pulling so that the adhesive 35 releases from the silicone release material 36. By grasping the tab 41 the second portion 21 is tensioned and the end 24 moved past the openable seam 50 between the lid 47 and the base 46, and down around the base 46 to overlie the bottom portion 51 of base 44. The adhesive 35 is then pressed into contact with the bottom 51, permanently adhering thereto, and providing the bar code 31 on the bottom 51 of the package 43 so that merely by moving the package 43 over a stationary scanner (such as in a grocery check out counter) the bar code 31 can be scanned.

Figure 7:
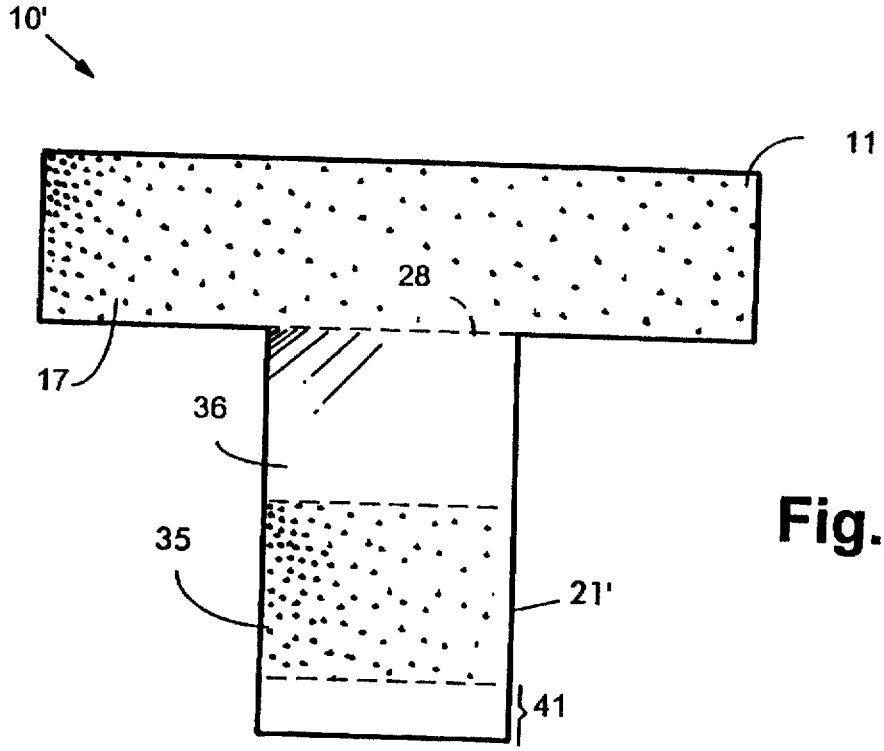
FIG. 7 is a bottom plan view of another modification of label assembly according to the present invention.

While the configuration of the label assembly 10 illustrated in FIGS. 1 through 6 is preferred, other configurations may also be provided. For example, for use with smaller clam shell containers, or other types of containers, or where it is not necessary to provide bar coding on the bottom of a container, the label assembly 10' illustrated in FIG. 7 may be utilized. In FIG. 7 components the same as those in the FIG. 2 embodiment are illustrated by the same reference numeral. Note that in this embodiment the portion 21' is simply shorter—by the length of the portion between the fold lines 28, 38 of the FIG. 2 embodiment—than the portion 21 in the FIG. 2 embodiment.

Figure 8:
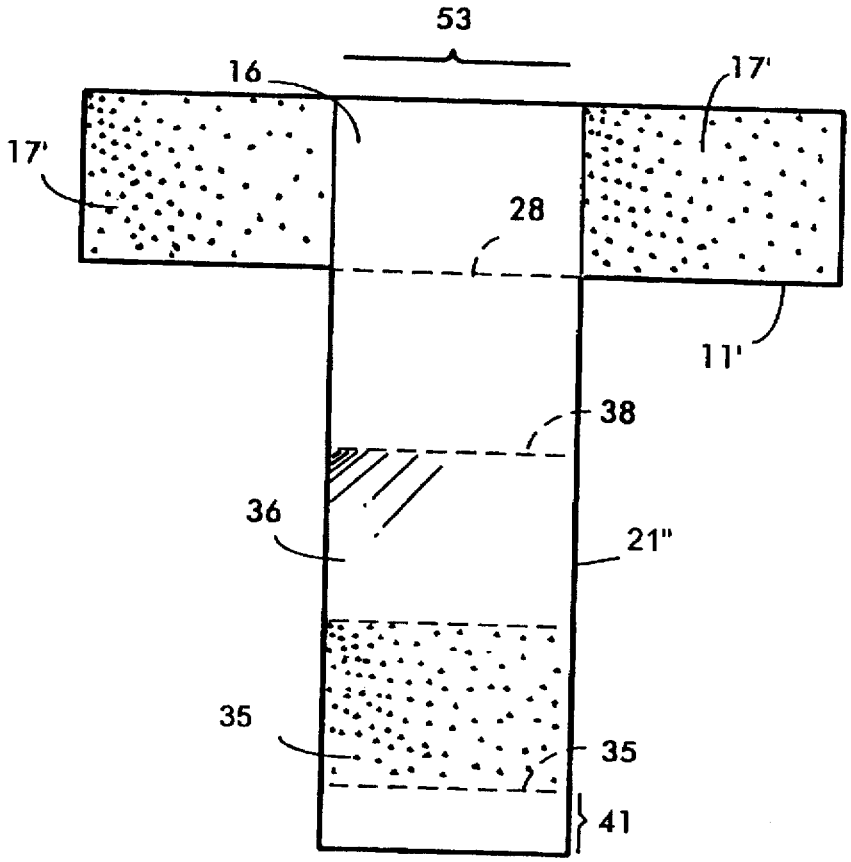
FIG. 8 is a bottom plan view of yet another label assembly according to the invention.

In the FIG. 8 embodiment the face 16 of the portion 11 has a non-adhesive central section 53 so that the portion 21" may be folded under the portion 11', overlapped by the non-adhesive section 53. In this embodiment the fold line 39 is eliminated and the distance between the fold lines 28, 38 compressed. The tab 41 will extend outwardly from beneath the first portion 11', and may be grasped and pulled to deploy the rest of the portion 21".

Other modifications aside from those illustrated in FIGS. 7 and 8 may also be provided, the whole purpose merely being to provide a folded configuration and a deployed configuration with adhesive inactive when folded, and sealable to a container (such as a clam shell container) when deployed.

It will thus be seen that according to the present invention a label assembly suitable for sealing packages, especially packages for produce, has been provided, as well as an advantageous package assembly and method of packaging produce. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent assemblies and methods.

What is claimed is:

1. A packaging label assembly comprising:

a first portion comprising a base elongated in a first dimension and having first and second opposite faces;

a first pressure sensitive adhesive pattern on said first portion second face covering at least part of said second face;

a second portion comprising a base elongated in a second dimension substantially perpendicular to said first dimension and having first and second opposite faces and first and second ends spaced from each other in said second dimension of elongation;

said second portion connected to said first portion adjacent said first end thereof so that said first and second faces of said first and second portions may be disposed so that they are substantially coplanar;

a first fold line adjacent said first end of said second portion for allowing folding of said second portion with respect to said first portion;

indicia on said second portion first face;

a second pressure sensitive adhesive pattern on said second portion second face remote from said first fold line;

a non-stick area of said second portion second face between said first fold line and said second adhesive pattern; and a second fold line between said second adhesive pattern and said non-stick area.

2. A label assembly as recited in claim 1 wherein said second adhesive pattern comprises a pattern of permanent adhesive, and wherein said non-stick area comprises silicone release material substantially co-extensive in area with said second adhesive pattern.

3. A label assembly as recited in claim 2 further comprising a lift tab at said second end of said second portion, devoid of adhesive on said second face thereof.

4. A label assembly as recited in claim 2 wherein said indica on said second portion first face includes food nutritional information, and further includes bar coding opposite said second adhesive portion.

5. A label assembly as recited in claim 2 further comprising a third fold line in said second portion adjacent said non-stick area on the opposite side thereof from said second adhesive pattern, and a fourth fold line in said second portion between said first and third fold lines; and wherein the length of said first portion between said first end and said second end thereof is between about four-eight inches.

6. A label assembly as recited in claim 2 wherein said first adhesive pattern comprises permanent adhesive that substantially completely covers said second face of said first portion.

7. A label assembly as recited in claim 1 further comprising a lift tab at said second end of said second portion, devoid of adhesive on said second face thereof.

8. A label assembly as recited in claim 7 wherein said first and second portions comprise an integral piece of cellulose stock.

9. A label assembly as recited in claim 1 wherein said indica on said second portion first face includes food nutritional information, and further includes bar coding opposite said second adhesive portion.

10. A label assembly as recited in claim 9 wherein said first and second portions comprise an integral piece of cellulose stock.

11. A label assembly as recited in claim 1 further comprising a third fold line in said second portion adjacent said non-stick area on the opposite side thereof from said second adhesive pattern, and a fourth fold line in said second portion between said first and third fold lines; and wherein the length of said first portion between said first end and said second end thereof is between about four-eight inches.

12. A label assembly as recited in claim 11 wherein said second portion second face between said first and third fold lines is devoid of adhesive.

13. A label assembly as recited in claim 11 wherein said indica on said second portion first face includes food nutritional information, and further includes bar coding opposite said second adhesive portion.

14. A label assembly as recited in claim 13 wherein said first adhesive pattern comprises permanent adhesive that substantially completely covers said second face of said first portion.

15. A label assembly as recited in claim 14 further comprising indicia, indicating the contents of a package, on said first portion first face.

16. A label assembly as recited in claim 13 further comprising indicia, indicating the contents of a package, on said first portion first face.

17. A label assembly as recited in claim 1 wherein said first adhesive pattern comprises permanent adhesive that substantially completely covers said second face of said first portion.

18. A label assembly as recited in claim 7 further comprising indicia, indicating the contents of a package, on said first portion first face.

19. A label assembly as recited in claim 1 wherein said first and second portions comprise an integral piece of cellulose stock.

20. A label assembly as recited in claim 1 further comprising indicia, indicating the contents of a package, on said first portion first face.

* * * * *